US010112078B1

(12) United States Patent
Sailer et al.

(10) Patent No.: US 10,112,078 B1
(45) Date of Patent: Oct. 30, 2018

(54) STEP ASSEMBLY WITH FALL ARREST CAPABILITY INCLUDING REMOVABLE STEP

(71) Applicant: VAF Industries, LLC, Escondido, CA (US)

(72) Inventors: Glenn Sailer, Escondido, CA (US); Raymond Tai, San Marcos, CA (US)

(73) Assignee: VAF Industries, LLC, Escondido, CA (US)

( * ) Notice: Subject to any disclaimer, the term of this patent is extended or adjusted under 35 U.S.C. 154(b) by 0 days.

(21) Appl. No.: 15/657,002

(22) Filed: Jul. 21, 2017

(51) Int. Cl.
*A63B 27/00* (2006.01)

(52) U.S. Cl.
CPC ..... *A63B 27/00* (2013.01)

(58) Field of Classification Search
CPC ..... A63B 27/00
USPC ..... 182/92
See application file for complete search history.

(56) References Cited

U.S. PATENT DOCUMENTS 601,849 A * 4/1898 Akin
907,483 A * 12/1908 Ette
3,399,746 A * 9/1968 Wood ..... E06C 9/04 182/100
3,473,628 A * 10/1969 Lindsey ..... E04H 12/00 182/189
3,497,033 A * 2/1970 Herrenkohl ..... A63B 27/00 182/92
5,544,717 A * 8/1996 White ..... A62B 35/0068 182/90
5,702,216 A * 12/1997 Wu ..... F16B 13/066 411/32
5,813,808 A * 9/1998 Wu ..... F16B 13/068 411/24
5,941,485 A * 8/1999 Davidson ..... E04H 12/08 248/218.4
6,378,822 B1 * 4/2002 Franks ..... E06C 1/34 182/90
6,491,272 B1 * 12/2002 Franks ..... E06C 1/34 182/92
6,595,323 B2 * 7/2003 Lindsey ..... E06C 1/34 182/92
9,409,055 B1 * 8/2016 Niemela ..... A63B 27/00
D805,658 S * 12/2017 Sailer ..... D25/69
2002/0106256 A1 * 8/2002 Kaibach ..... F16B 13/0858 411/60.1
2009/0045012 A1 * 2/2009 Mencl ..... A63B 27/00 182/92
2015/0290498 A1 * 10/2015 Bussewitz ..... A63B 27/00 182/90

* cited by examiner

*Primary Examiner* — Alvin C Chin-Shue
(74) *Attorney, Agent, or Firm* — LambentIP

(57) ABSTRACT

Disclosed is a step assembly with fall arrest capability for use in climbing a utility structure, including a removable step unit. The step assembly comprises the step unit including two leg members, a leg holder including two cylinders, and an expansion anchor including multiple fins. The combination of the leg holder and the expansion anchor is configured to be secured with the utility structure based on bending the fins at the shoulder sections to have the fins opened inside the utility structure while the leg holder is in contact with and outside the utility structure. The step unit can be detachably attached to the secured combination by inserting the two leg members through the two cylinders of the leg holder, respectively.

11 Claims, 15 Drawing Sheets

STEP ASSEMBLY WITH FALL ARREST CAPABILITY INCLUDING REMOVABLE STEP

BACKGROUND

The present invention broadly relates to equipment for climbing utility structures, such as utility towers and utility poles.

Fall arrest is one form of fall protection, regulations of which are specified by OSHA to prevent individuals working at height from fall injury. Personal fall arrest is one type of fall arrest, and a personal fall arrest system typically includes at least the following four key elements: anchorage, body wear, connector, and deceleration device. An anchorage is a secure point, often referred to as a tie-off point, for attachment to a structural part such as a rebar, I-beam, scaffolding and the like. A body wear is typically a body harness worn by the worker. A deceleration device has a mechanism to dissipate a substantial amount of energy and force associated with a fall arrest event. Examples of deceleration device include a rope grab, shock-absorbing lanyard, fall limiter, self-retracting lifeline and the like, one end of which can be coupled to a body wear. A connector is a device used to couple the other end of the deceleration device to the anchorage, such as a cross-arm strap, beam anchor, snap-hook, carabiner and the like. Each of these parts of a personal fall arrest system is typically required to sustain a minimum of 5,000 pounds per worker.

A utility tower is typically constructed to have threaded holes, which are to be engaged with threaded step rungs. Such a step rung is typically formed to have a shape of a bolt, i.e., an elongated solid cylinder with a threaded end portion, which is fastened with a fastener such as one or more nuts to secure the engagement with the threaded hole. A utility pole is typically constructed to have holes where step rungs are to be inserted. The end portion of such a step rung may include a hook, clip or the like properly shaped for securing the step rung through the hole.

Utility workers climb utility structures, such as utility towers and utility poles, for repair, construction, maintenance and other purposes, with a variety of safety equipment. Conventional techniques addressing fall arrest in climbing a utility tower or pole include use of an independent component, such as a carabiner, climbing clip, hook and the like, to couple the deceleration device to the step rung installed with the structure. Other examples include a step rung integrated with an attachment to allow the climber to hook in a hook or clip installed at the end of the deceleration device, or to weave a climbing cable or rope around the step rung. However, these conventional techniques often fail to meet the requirement of supporting a load of 5,000 pounds or greater per worker. Therefore, there is a need for an easily installable step rung with reliable fall arrest capability. Furthermore, it is desirable to have a removable step, which can be carried away by the worker after use, instead of remaining installed with the utility structure while unused.

DETAILED DESCRIPTION

This document describes a step assembly with fall arrest capability, which can be used in climbing a utility structure, such as a utility tower or a utility pole. The present step assembly includes a step unit to place a foot on, which can be removed from the assembly while being unused. Details of the structure and mechanism are explained below with reference to accompanying drawings.

Figure 1:
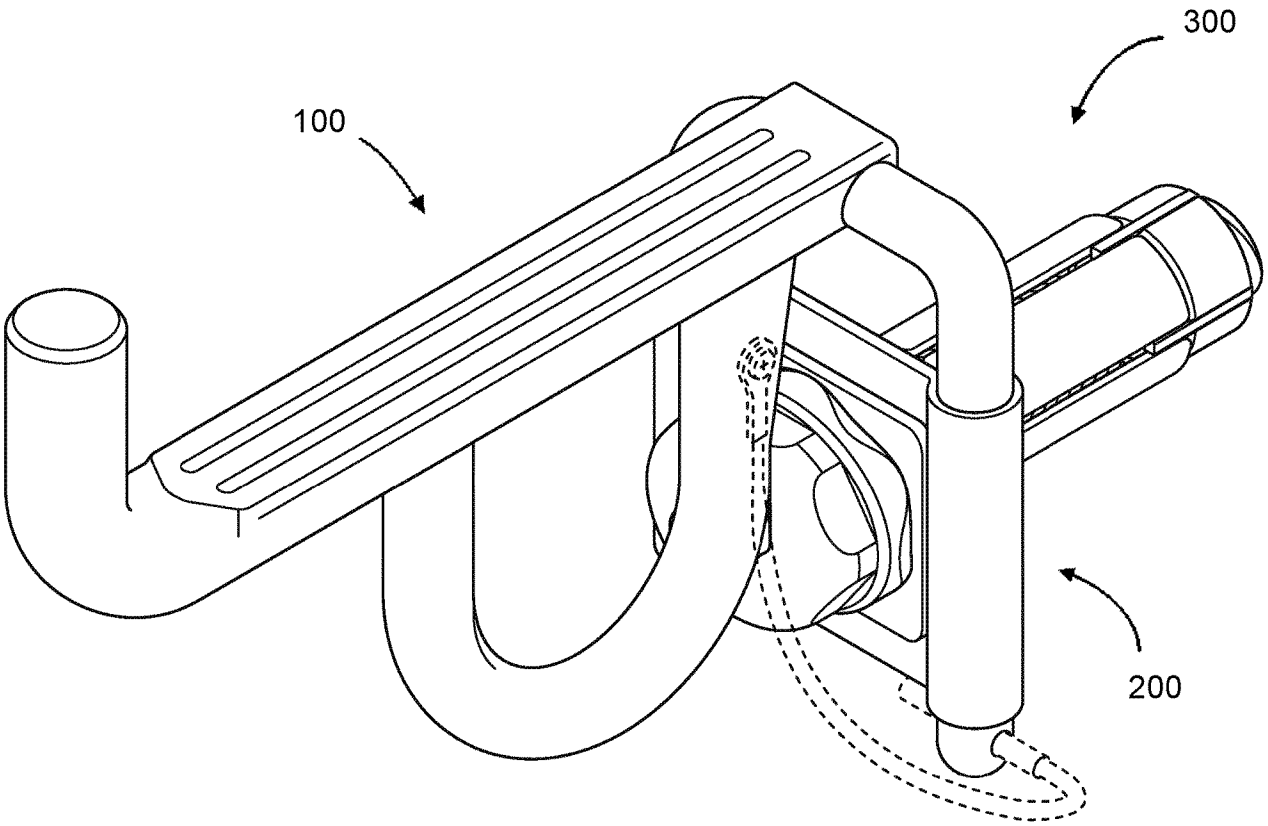
FIG. 1 is a perspective view of the present step assembly in an assembled configuration. The step assembly according to an embodiment includes three main components: a step unit, a leg holder and an expansion anchor.
Figure 2:
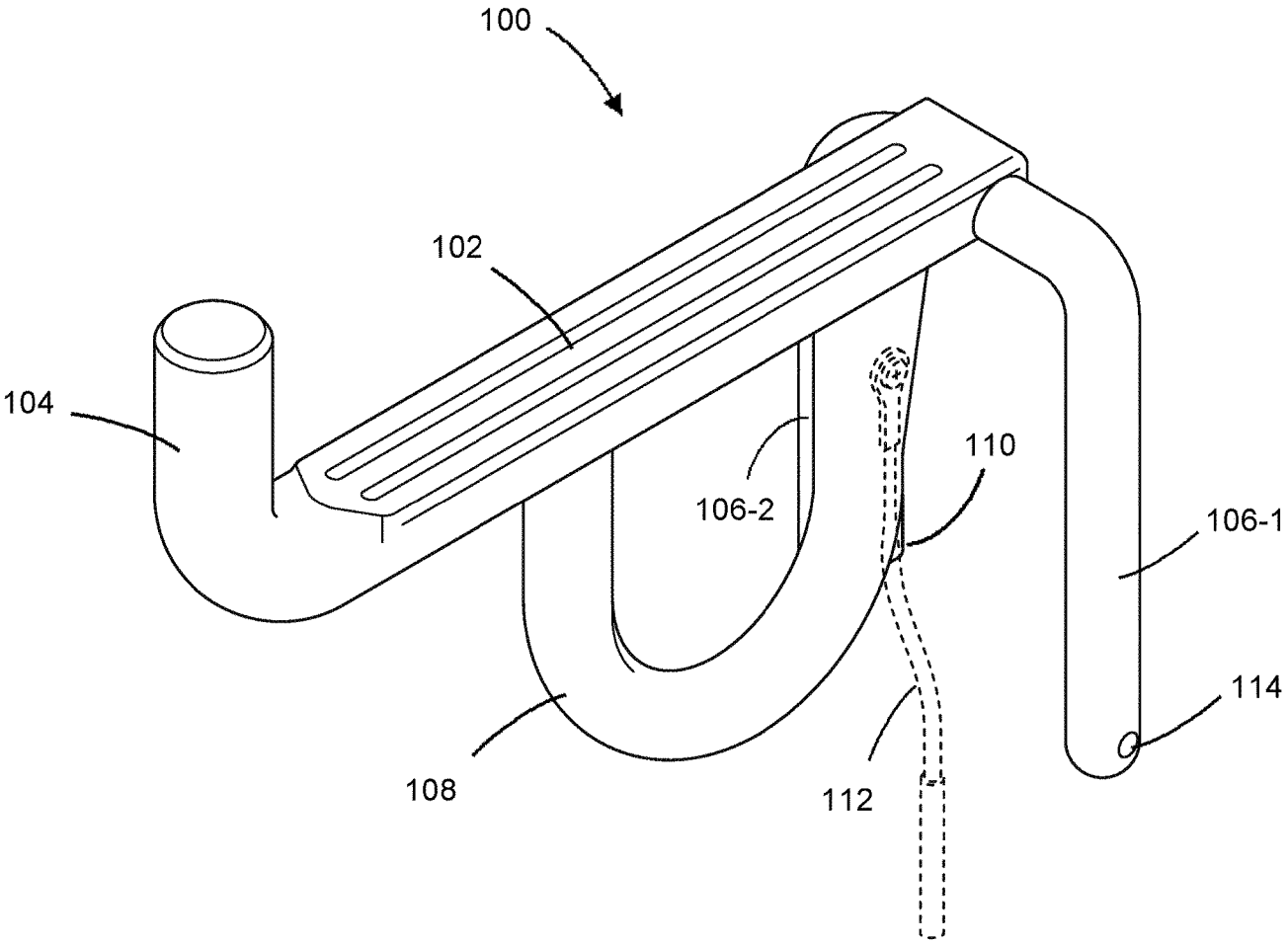
FIGS. 2-8 show various views of the step unit, i.e., a perspective view, a front view, a rear view, a left side view, a right side view, a top view, and a bottom view, respectively.
Figure 4:
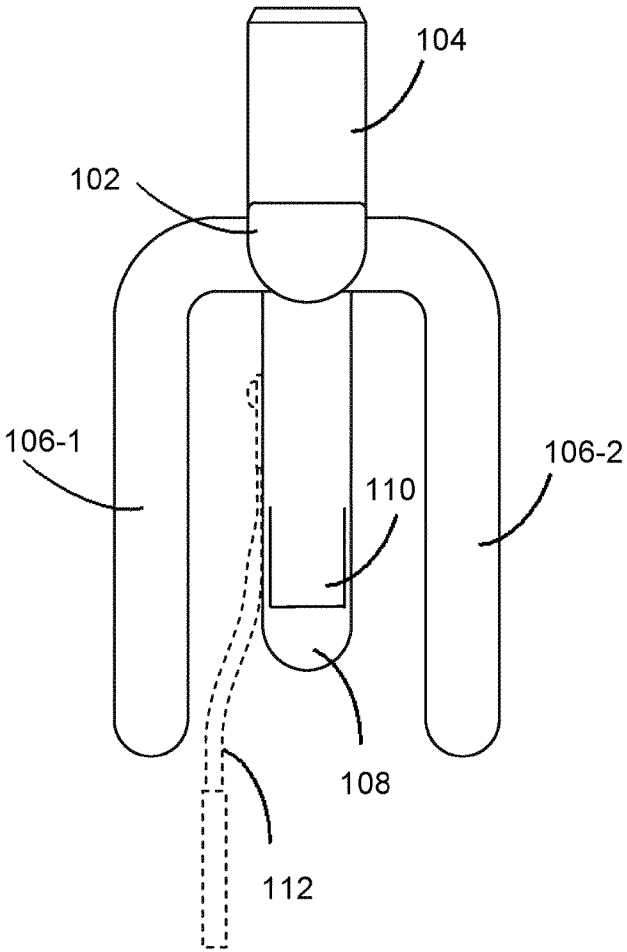
Figure 3:
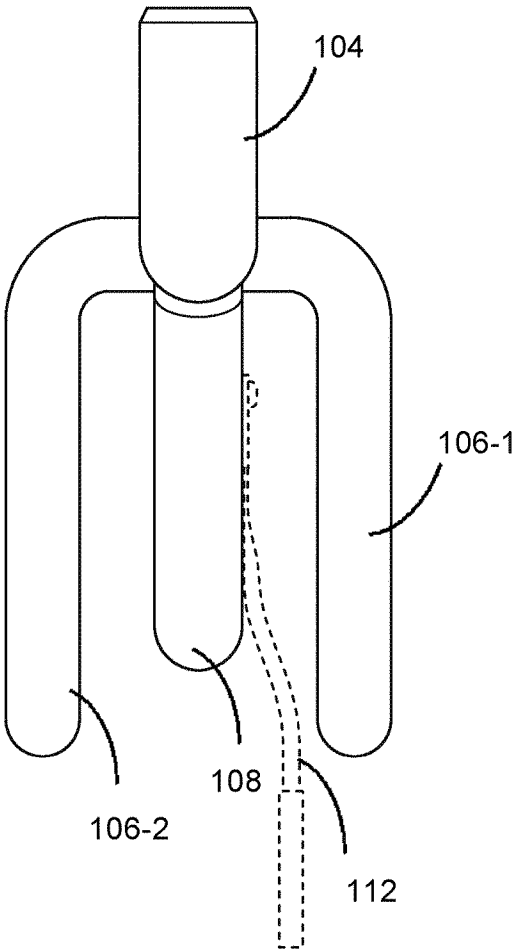
Figure 5:
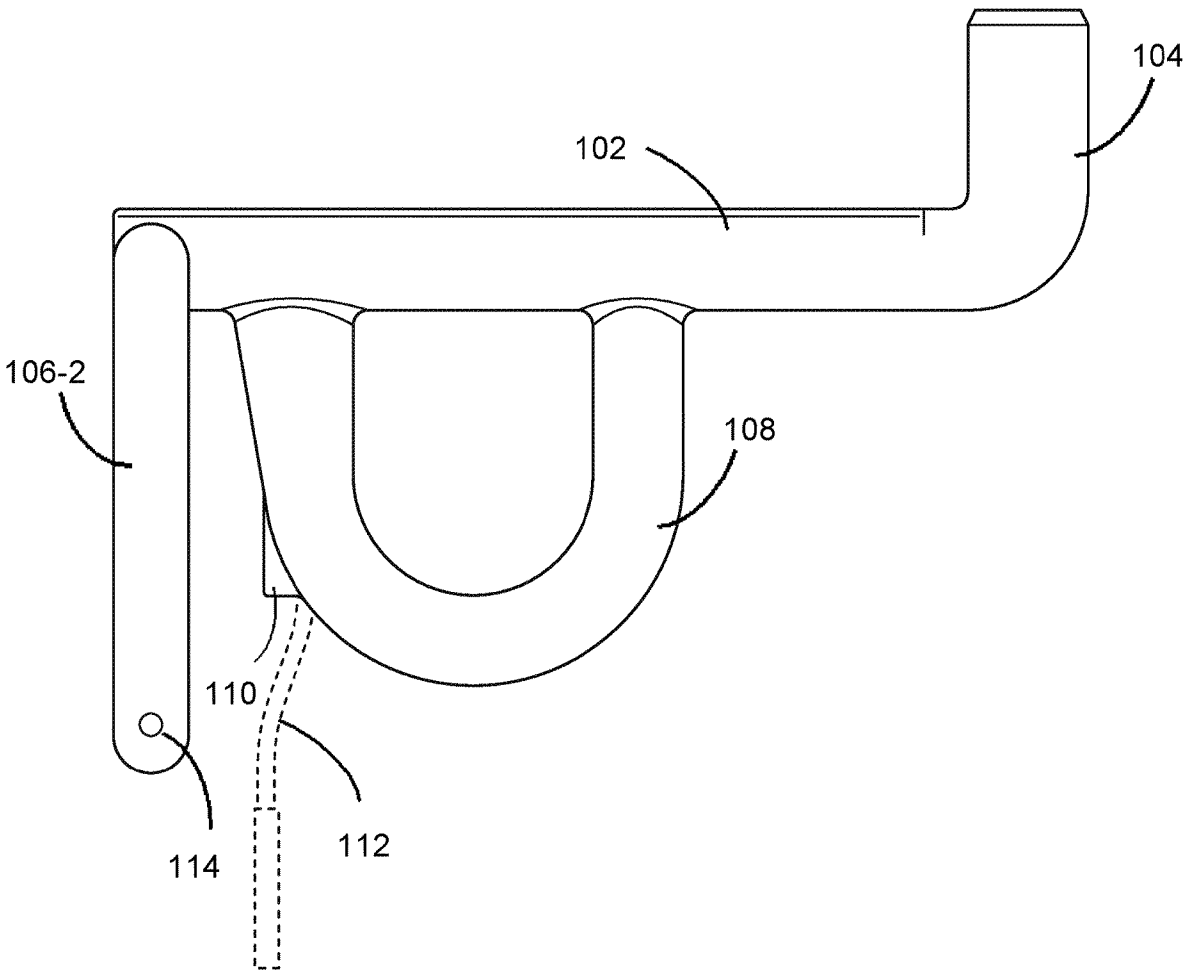
Figure 6:
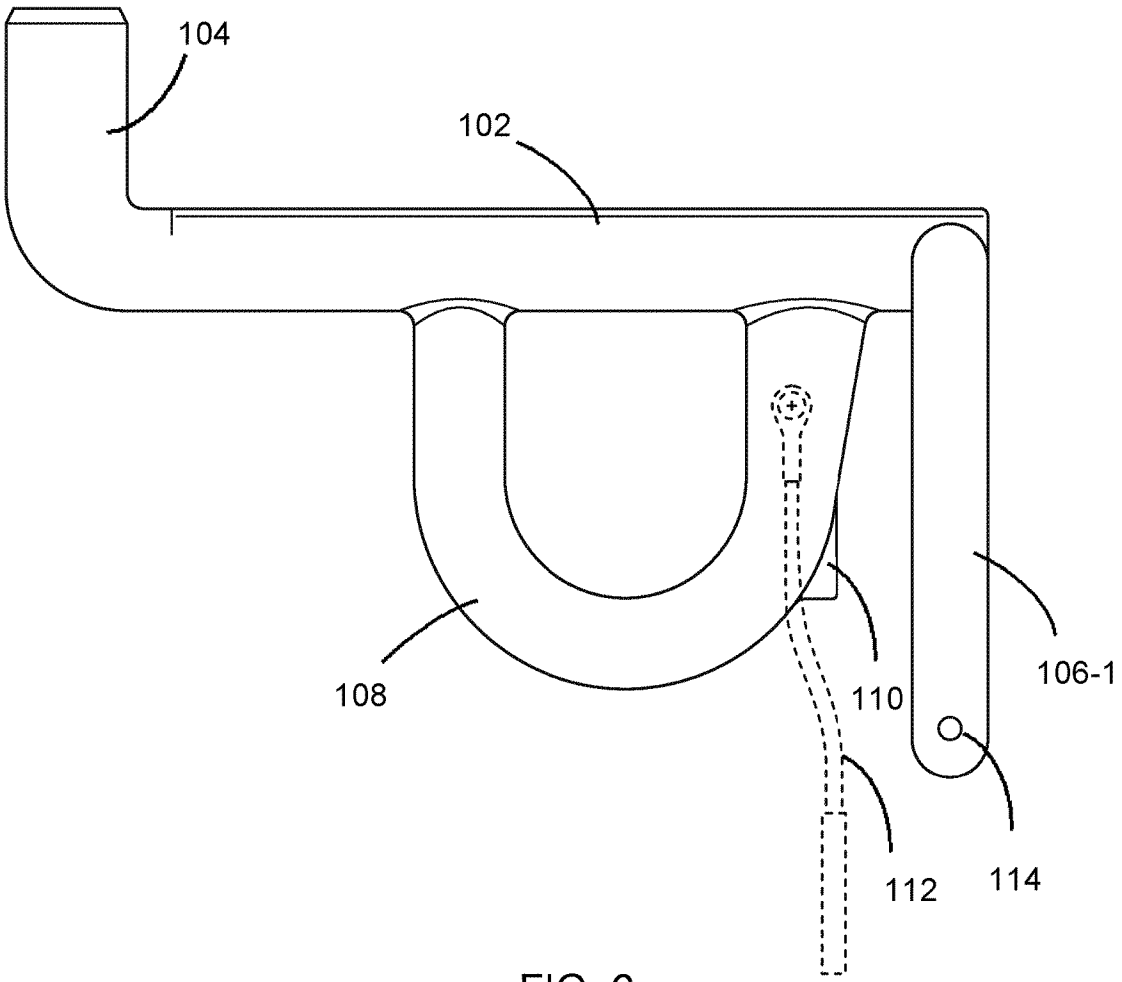
Figure 8:
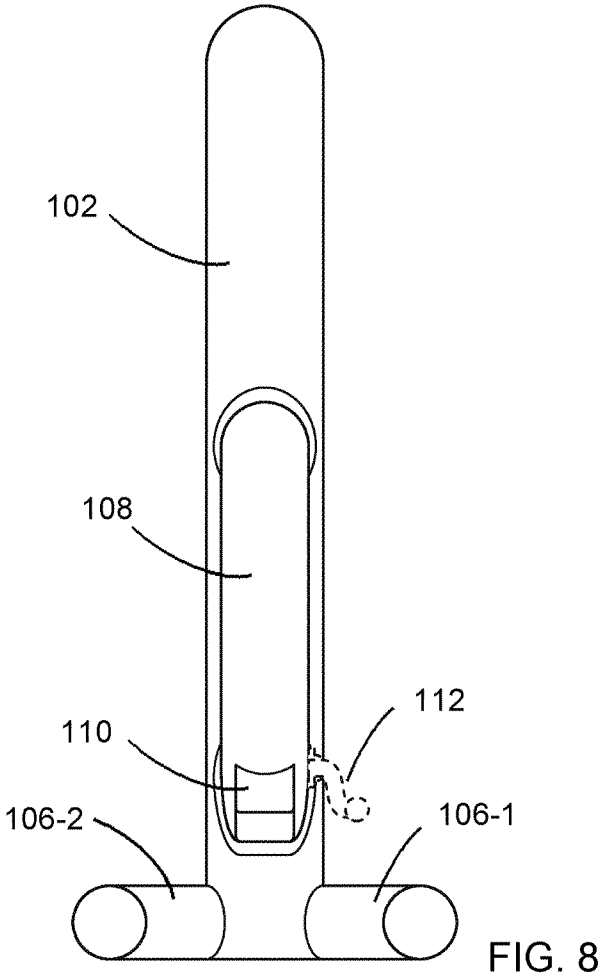
Figure 7:
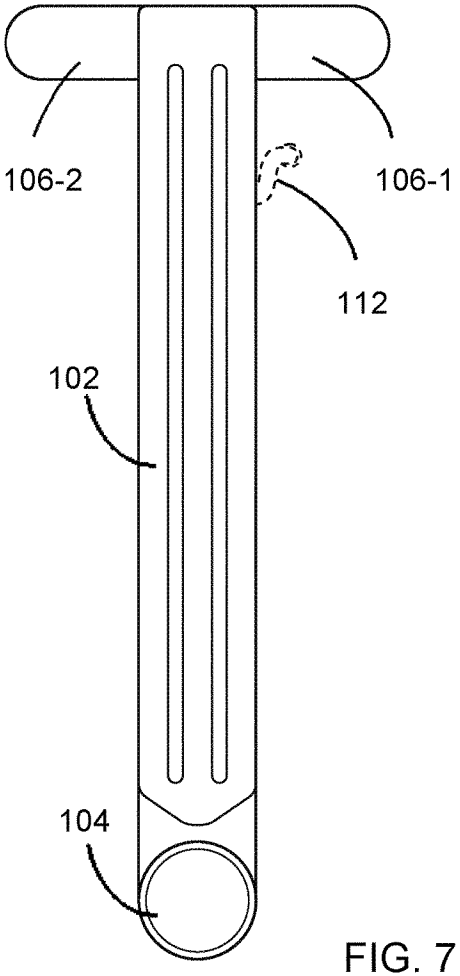
Figure 9:
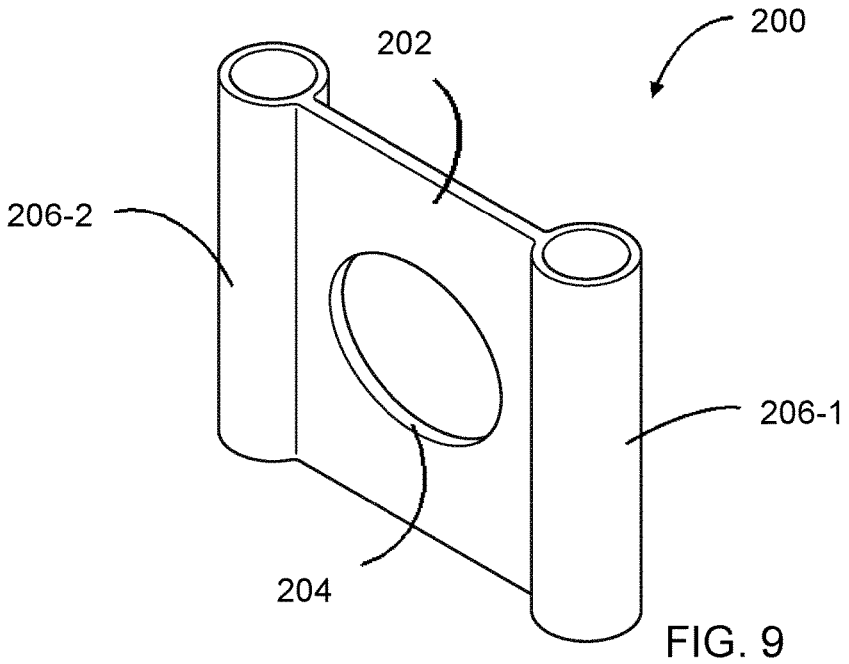
FIGS. 9-12 show various views of the leg holder, i.e., a perspective view, a front view that is the same as a rear view, a right side view that is the same as the left side view, and a top view that is the same as a bottom view, respectively.
Figure 10:
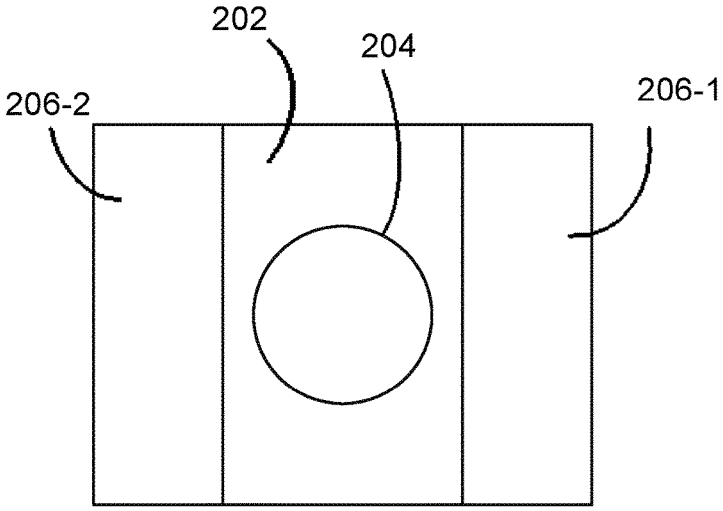
Figure 11:
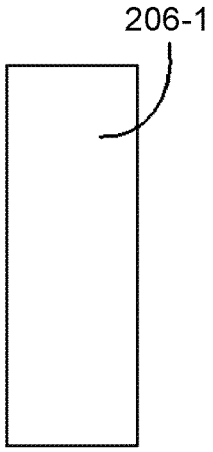
Figure 12:
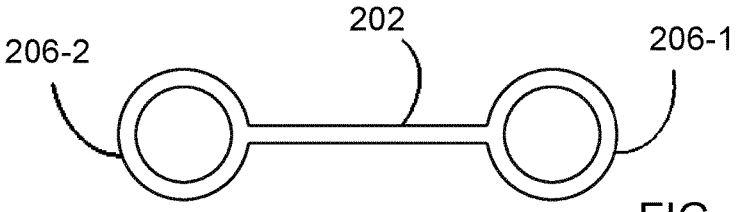

FIG. 1 is a perspective view of the present step assembly in an assembled configuration. The step assembly according to an embodiment includes three main components: a step unit 100, a leg holder 200 and an expansion anchor 300.

Details of the step unit 100 are explained below with reference to FIGS. 2-8, which show various views of the step unit 100, i.e., a perspective view, a front view, a rear view, a left side view, a right side view, a top view, and a bottom view, respectively. The step unit 100 includes a rod member comprising a first rod 102 elongated in the longitudinal direction, a second rod 104 elongated in the transversal direction and connected to one end of the first rod 102. The rod member is formed to have the first rod 102 and the second rod 104 substantially orthogonal to each other, resembling a shape of a generally letter L with the rounded corner provided by the connecting portion. In this example, the length of the second rod 104 is configured to be shorter than that of the first rod 102. The first rod 102 has a top flat surface along the longitudinal direction on which a foot can be placed. The top flat surface of the first rod 102 may have grooves or ridges formed along the longitudinal direction to reduce transversal slippage of the foot. The second rod 104 may be configured to have a height higher than a thickness of the foot to serve as a stopper to prevent the foot from slipping sideways. Note here that the word "foot" is used in a general sense, including a shoe or other article the worker generally wears. One end of the first rod 102 is connected to the second rod 104, and the other end of the first rod 102 is connected to the center of a two-leg support, which includes two leg members 106-1 and 106-2 transversally coupled to the first rod 102. Thus, the two leg members 106-1 and 106-2 are positioned downward along the vertical direction when the first rod 102 is positioned along the horizontal direction. The bottom part, opposite to the top flat surface, of the first rod 102 is attached with a loop section 108. Two end portions of the loop section 108 are attached to the bottom part of the first rod 102 at different points, thereby providing a generally D-shape opening defined by the loop section 108 and the part of the first rod 102 between the two end portions of the loop section 108. A bumper 110 may be formed at the rear side of the loop section 108 to provide a substantially flat vertical surface to meet the head of the bolt of the expansion anchor 300, as shown in FIG. 1.

In the present step assembly, the loop section 108 is configured for use as an anchorage of a fall arrest system. In the configuration illustrated in FIG. 2, the loop section 108 is positioned to point downward substantially in the vertical direction, i.e., the direction opposite to the ascending direction, and the top flat surface of the first rod 102 is oriented to face upward substantially in the vertical direction, i.e., the ascending direction. As mentioned earlier, a deceleration device has a mechanism to dissipate a substantial amount of energy and force associated with a fall arrest event. Examples of deceleration device include a rope grab, shock-absorbing lanyard, fall limiter, self-retracting lifeline and the like, one end of which can be coupled to a body harness the worker is wearing. The other end of the deceleration device may include a connector, such as a cross-arm strap, beam anchor, snap-hook, carabiner and the like, which can be used for engagement with the loop section 108 of the present step assembly. The load testing is typically conducted to ensure the sustainability of a minimum of 5,000 pounds.

A connection unit 112 (shown in broken line) may be attached to a side of the loop section 108. The connection unit 112 may include a pin at one end that is coupled to the loop section 108 though a wire, coil, spring or any other connecting line. As illustrated in FIG. 1, once the step unit 100 is attached to the leg holder 200, the pin can be inserted through a hole 114 made at an end portion of one of the leg members 106-1 and 106-2 to secure the attachment. When the pin is not inserted into the hole 114, the connection unit 112 can be hang loose, as illustrated in FIG. 2-8.

Details of the leg holder 200 are explained below with reference to FIGS. 9-12, which show various views of the leg holder 200, i.e., a perspective view, a front view that is the same as a rear view, a right side view that is the same as the left side view, and a top view that is the same as a bottom view, respectively. The leg holder 200 includes a center plate 202 having a circular opening 204 formed around the center and two cylinders 206-1 and 206-2 formed along two side edges, respectively. As shown in FIG. 1, the circular opening 204 is configured so that the expansion anchor 300 is inserted therethrough and maintained therein, and the two cylinders 206-1 and 206-2 are configured so that the two leg members 106-1 and 106-2 are inserted therethrough and maintained therein, respectively, when the present step assembly is assembled.

Figures 13, 14:
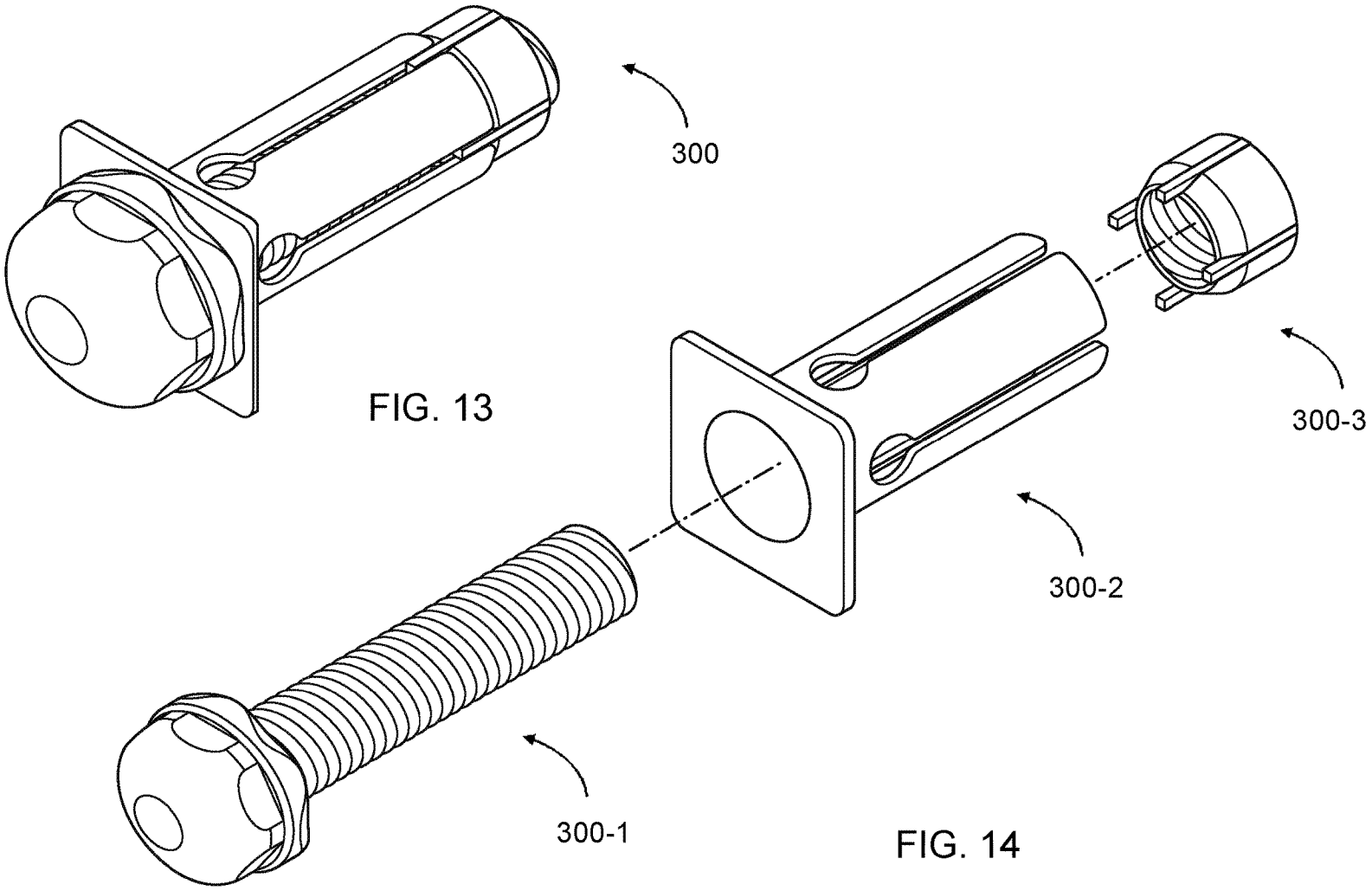
FIG. 13 is a perspective view of the expansion anchor in an assembled configuration.
FIG. 14 is an exploded view of the expansion anchor, separately showing three main components: a bolt, a fin unit, and a wedge unit.
Figure 15:
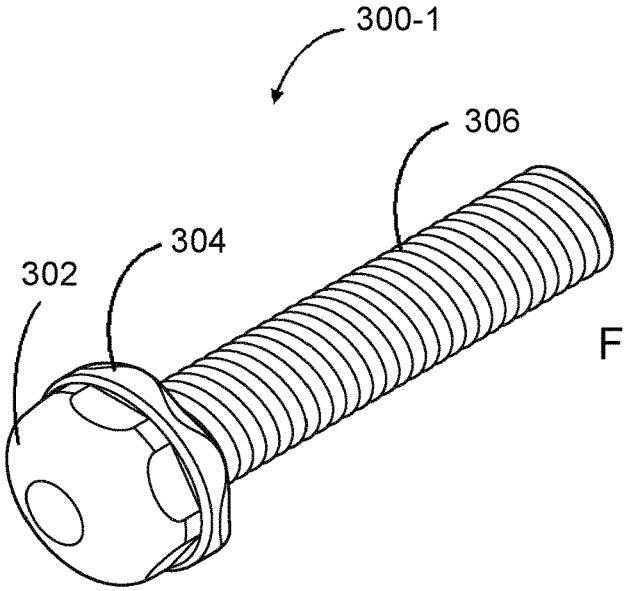
FIGS. 15-19 show various views of the bolt, i.e., a perspective view, a front view, a rear view, a side view, and another side view, respectively.
Figure 16:
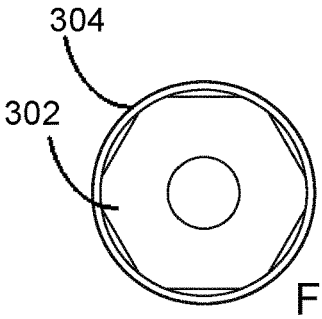
Figure 17:
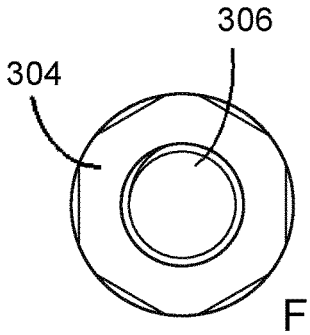
Figure 18:
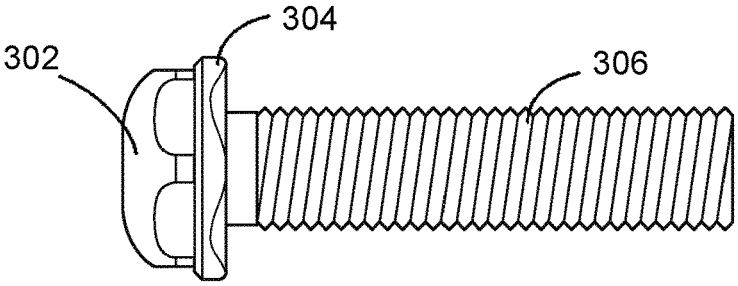
Figure 19:
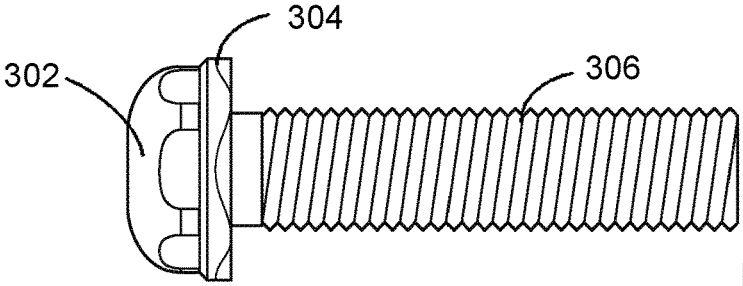
Figure 20:
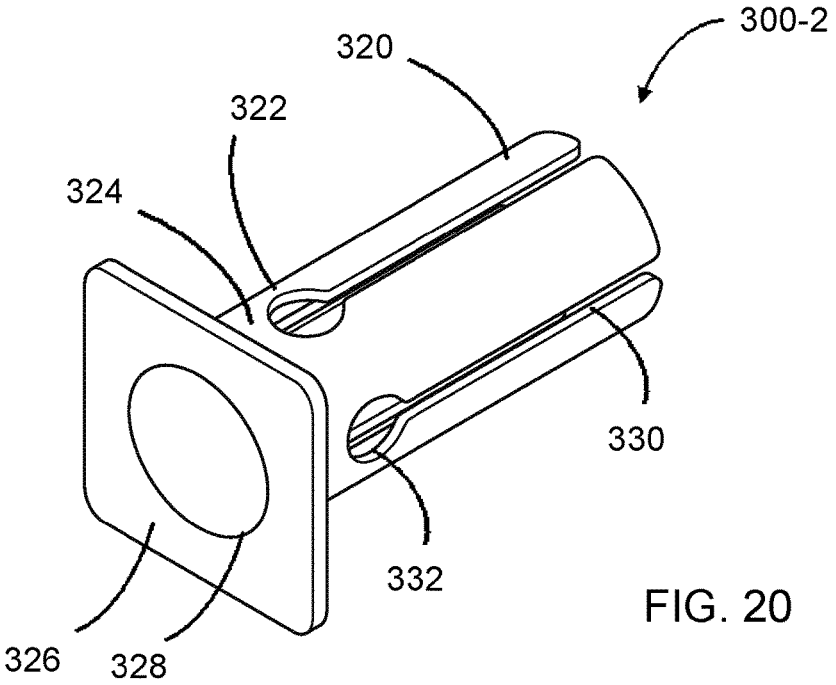
FIGS. 20-23 show various views of the fin unit, i.e., a perspective view, a front view, a rear view, and a side view, respectively.
Figure 21:
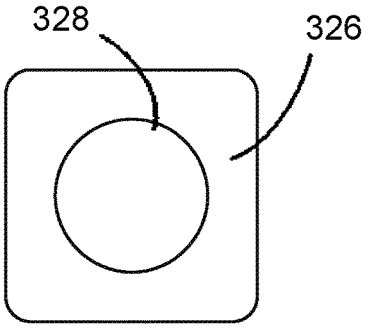
Figure 22:
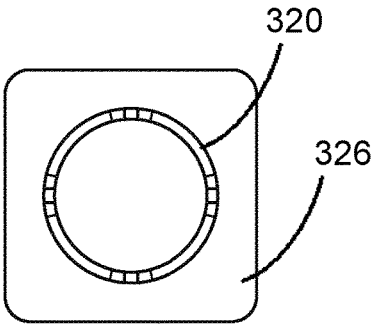
Figure 23:
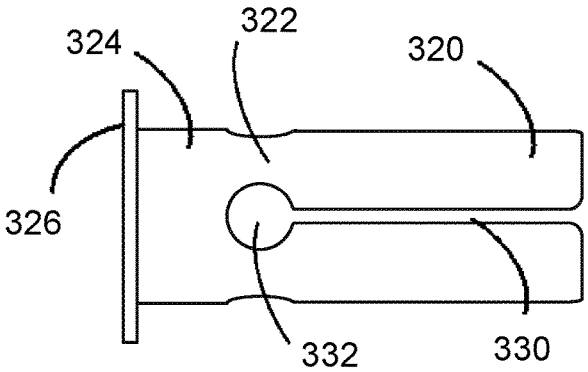
Figure 24:
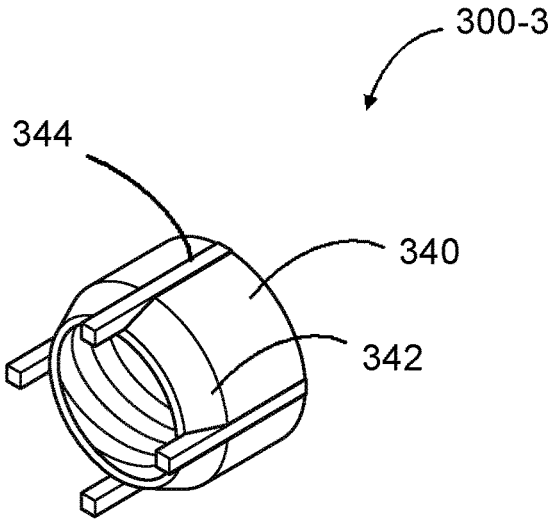
FIGS. 24-27 show various views of the wedge unit, i.e., a perspective view, a front view, a rear view, and a side view, respectively.
Figure 25:
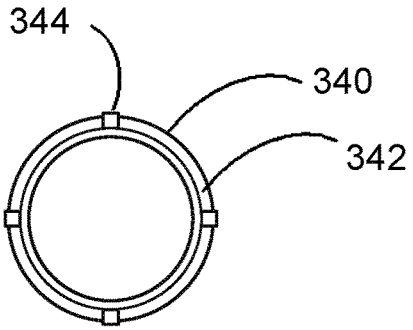
Figure 26:
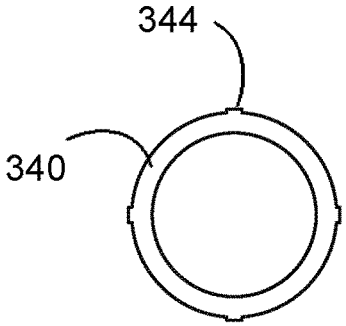
Figure 27:
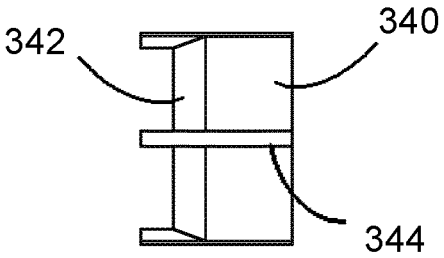

Details of the expansion anchor 300 are explained below with references to FIGS. 13-27. FIG. 13 is a perspective view of the expansion anchor 300 in an assembled configuration. FIG. 14 is an exploded view of the expansion anchor 300, separately showing three main components: a bolt 300-1, a fin unit 300-2, and a wedge unit 300-3. As shown in FIGS. 13 and 14, these three components are configured so that the bolt 300-1 is inserted longitudinally through the fin unit 300-2, and the wedge unit 300-3 meets and engages the end portion of the bolt 300-1 coming out from the other end of the fin unit 300-2.

FIGS. 15-19 show various views of the bolt 300-1, i.e., a perspective view, a front view, a rear view, a side view, and another side view, respectively. The bolt 300-1 includes a head section 302 formed at one end. The head section 302 has a cross-sectional shape along the transversal direction, which is orthogonal to the longitudinal direction of the bolt 300-1. The cross-sectional shape of the head section 302 may be a hexagon, a square, a rectangle, an oval, a circle, or any other shape. The circumference of the head section 302 may have multiple flat portions for ease of rotating the bolt 300-1 by the head section 302 using a wrench or other turning means. A flange section 304 is formed contiguous to the head section 302. The diameter of the cross-sectional shape of the flange section 304 is configured to be larger than that of the head section 302. The bolt 300-1 has a shank section 306 contiguous to the flange section 304, the shank section 306 being substantially a cylindrical shape and having a threaded surface. The flange section 304 serves as a stopper for the fin unit 300-2 when the shank section 306 is inserted through the fin unit 300-2, as can be seen in FIG. 14 where the exploded view of the expansion anchor 300 is shown.

FIGS. 20-23 show various views of the fin unit 300-2, i.e., a perspective view, a front view, a rear view, and a side view, respectively. The fin unit 300-2 includes multiple fins 320 that are cylindrically disposed, each fin having a generally rectangle portion curved slightly, wherein the multiple fins 320 are configured to surround and generally conform to the cylindrical shape of the shank section 306 of the bolt 300-1 when it is inserted. Each fin 320 has a shoulder section 322, the transversal dimension of which is smaller than that of the generally rectangle portion of the fin 320. The fin unit 300-2 includes a neck section 324, which has a generally ring shape with a first ring edge at one end and a second ring edge at the other end, and all the shoulder sections 322 are formed contiguous to the first ring edge of the neck section 324. The fin unit 300-2 further includes a collar section 326 formed contiguous to the neck section 324, the collar section 326 resembling a plate-like collar having a generally square shape formed transversal to the neck section 324. The collar section 326 has a collar opening 328 at the center. The edge of the collar opening 328 is formed contiguous to the second ring edge of the neck section 324. The diameter of the collar opening 328 is configured to be slightly larger than that of the shank section 306 of the bolt 300-1 so that the shank section 306 of the bolt 300-1 can be smoothly inserted through the collar opening 328. (See FIG. 14.) Four fins 320 are formed in this example; however, the number of fins 320 can be 2, 3, 5, 6 or more. The number of fins 320, hence the width of each fin 320, can be adjusted depending on the rigidity of the material and/or the fastening strength when the fins 320 are opened. The multiple fins 320 are cylindrically disposed to surround and generally conform to the cylindrical shape of the shank section 306 of the bolt 300-1 when it is inserted; each adjacent pair of the fins 320 is formed to have a longitudinal slit 330 therebetween. The front end of the longitudinal slit 330 is extended to form a circular cutout 332. Thus, the shoulder section 322 of each fin 320 is formed between a pair of adjacent circular cutouts 332. As explained later, the size of each circular cutout 332 and the distance between the circular cutout 332 and the collar section 326 can be adjusted depending on the utility structure where the expansion anchor 300 is used.

FIGS. 24-27 show various views of the wedge unit 300-3, i.e., a perspective view, a front view, a rear view, and a side view, respectively. The wedge unit 300-3 has a nut section 340 that has a generally cylindrical shape with a threaded inner surface. The pitch of the inner thread is configured to engage with the threaded surface of the shank section 306 of the bolt 300-1. The nut section 340 includes a tapered portion 342 providing a gradual decrease in diameter of the outer surface of the nut section 340 toward the front edge. Multiple wedge pins 344 having the same dimensions are formed longitudinally on the outer surface of the nut section 340, and equally spaced apart thereon. The length of the wedge pin 344 is longer than the length of the nut section 340, so that the portion of the wedge pin 344 protrudes from the front edge of the nut section 340. The number of the wedge pins 344 is the same as the number of the longitudinal slits 330 of the fin unit 300-2, and the dimensions of each wedge pin 344, including the protruding portion, are configured so that each wedge pin 344 slides in the corresponding longitudinal slit 330. This is to prevent the wedge unit 300-3 from moving rotationally around its axis.

Figure 28:
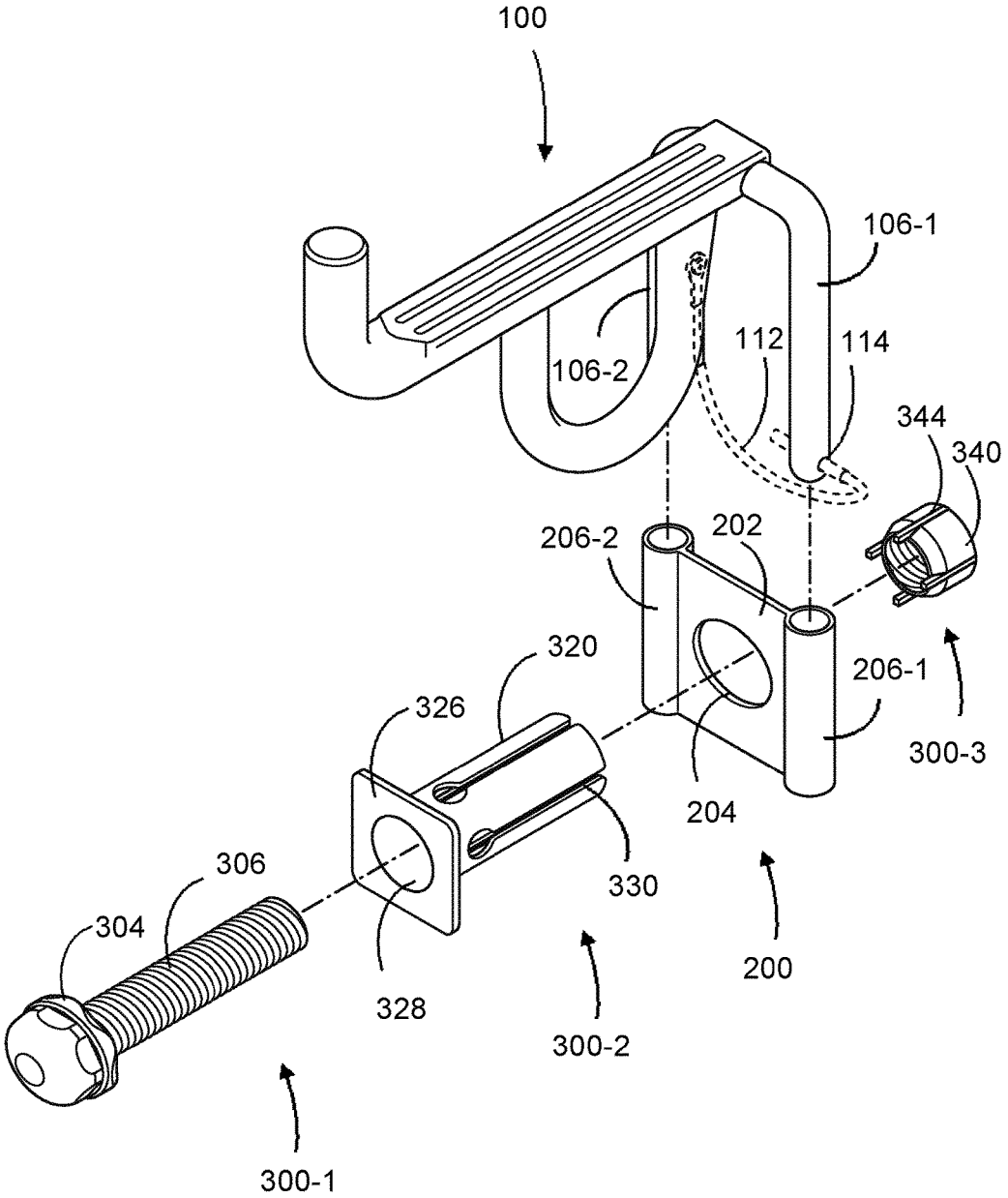
FIG. 28 is an exploded view of the present step assembly, separately showing the step unit, the support plate, the bolt, the fin unit and the wedge unit.

FIG. 28 is an exploded view of the present step assembly, separately showing the step unit 100, the leg holder 200, the bolt 300-1, the fin unit 300-2, and the wedge unit 300-3. To get the assembled configuration shown in FIG. 1, the following procedure can be taken: (i) insert the shank section 306 of the bolt 300-1 through the collar opening 328 and the circularly formed inner surfaces of the fins 320 of the fin unit 300-2; (ii) attach the wedge unit 300-3 at the rear end portion of the bolt 300-1 coming out from the fin unit 300-2 by engaging the inner thread of the nut section 340 of the wedge unit 300-3 with the outer thread of the shank section 306 of the bolt 300-1; (ii) adjust the attachment so that the protruded portions of the multiple wedge pins 344 fit in the rear end portions of the longitudinal slits 330, respectively, whereby the expansion anchor 300 is assembled at this point, as shown in FIG. 13; (iv) insert the assembled expansion anchor 300 through the circular opening 204 of the leg holder 200 such that the center plate 202 of the leg holder 200 is placed adjacent to and in contact with the rear side of the collar section 326 of the fin unit 300-2, and the front side of the collar section 326 is placed adjacent to and in contact with the flange section 304 of the bolt 300-1. The dimensions of the collar section 326, which has a generally square shape, are configured such that the entire collar section 326 can fit between the two cylinders 206-1 and 206-2. In other words, the width of the collar section 326 and the width of the center plate 202 are substantially the same such that the two side edges of the collar section 326 will align and contact with the two cylinders 206-1 and 206-2, respectively, when the collar section 326 is placed adjacent to and in contact with the center plate 202. This is to prevent the fin unit 300-2 from moving rotationally around its axis once assembled as above. The order of the above (i)-(iv) steps can be changed, as long as the combination of the assembled expansion anchor and the leg holder is obtained, the combination having the expansion anchor inserted through the circular opening 204 of the leg holder 200 and the collar section 326 of the fin unit 300 being adjacent to and in contact with the center plate 202 of the leg holder 200. Thereafter, the step unit 100 can be detachably attached to the combination of the expansion anchor 300 and the leg holder 200, by inserting the leg members 106-1 and 106-2 through the cylinders 206-1 and 206-2, respectively. To secure the attachment, the pin at the end of the connection unit 112 can be inserted through the hole 114 formed at the end portion of one of the leg members 106-1 and 106-2. The perspective view of the assembled step assembly is shown in FIG. 1.

Figure 29:
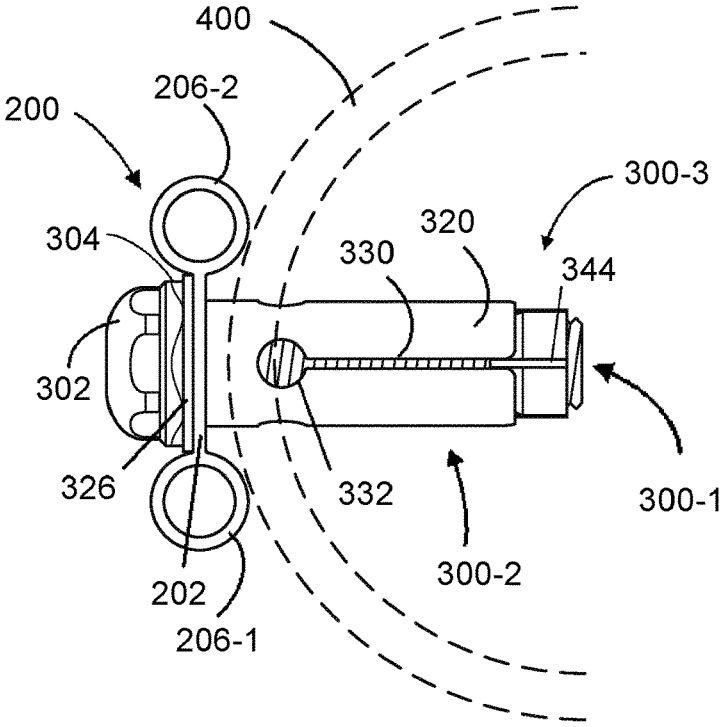
FIG. 29 is a top view of the combination of the leg holder and the expansion anchor, which is installed with the utility structure with the fins closed.
Figure 30:
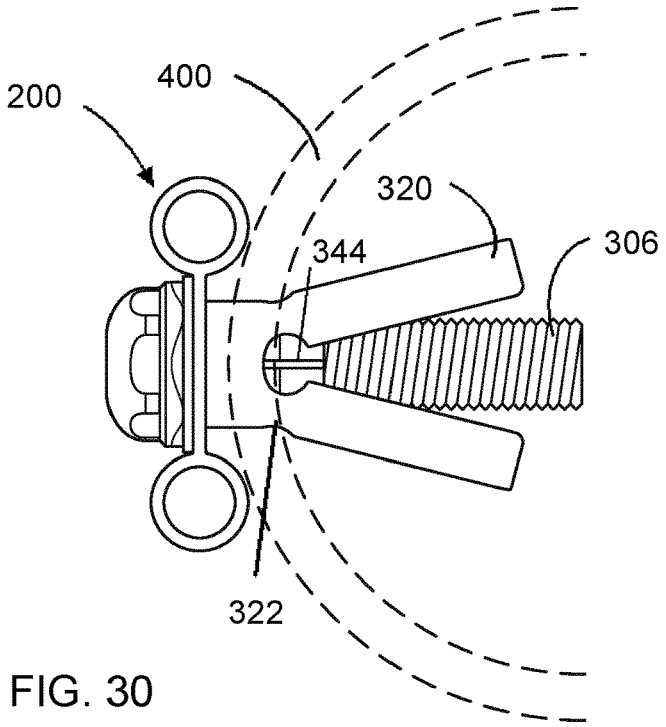
FIG. 30 is a top view thereof with the fins opened.

The installation mechanism of the present step assembly using the expansion anchor 300 is explained below with reference to FIGS. 29-31. FIG. 29 is a top view of the combination of the leg holder 200 and the expansion anchor 300, which is installed with the utility structure 400 with the fins 320 closed. FIG. 30 is a top view thereof with the fins 320 opened. The wall of the utility structure 400, such as a utility pole, is depicted in broken line. The wall has a certain thickness, for example, ⅝-½ inch such as 12 mm. A hole through the wall can be pre-made before installing the step assembly, and the diameter of the hole may be about 1 inch (25.4 mm), for example. As shown in FIG. 29, the combination of the leg holder 200 and the expansion anchor 300 is installed with the utility structure 400 by inserting the expansion anchor 300 through the hole so that the head section 302, the flange section 304, the collar section 326, and the leg holder 200 are next to each other in this sequence and placed outside the wall of the utility structure 400, wherein the cylinders 206-1 and 206-2 are in contact with the outer surface of the wall. The center plate 202 of the leg holder 200 is placed adjacent to and in contact with the rear side of the collar section 326 of the fin unit 300-2, and the front side of the collar section 326 is placed adjacent to and in contact with the flange section 304 of the bolt 300-1. The dimensions of the collar section 326, which has a generally square shape, are configured such that the entire collar section 326 can fit between the two cylinders 206-1 and 206-2. In other words, the width of the collar section 326 and the width of the center plate 202 are substantially the same such that the two side edges of the collar section 326 will align and contact with the two cylinders 206-1 and 206-2, respectively, when the collar section 326 is placed adjacent to and in contact with the center plate 202. This is to prevent the fin unit 300-2 from moving rotationally around its axis once assembled as above.

Figure 31:
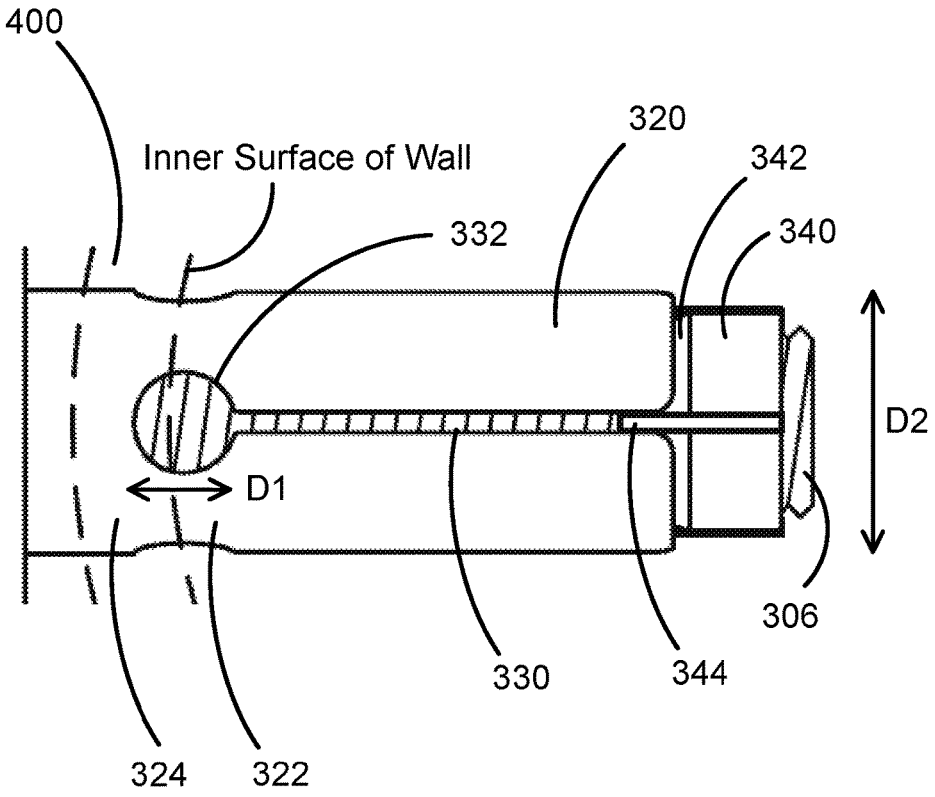
FIG. 31 is an expanded view around the circular cutout of the configuration corresponding to FIG. 29.

FIG. 31 is an expanded view around the circular cutout 332 of the configuration corresponding to FIG. 29. The dimensions of the expansion anchor 300 are configured such that part of the neck section 324 and part of the shoulder section 322 are inside the hole pre-made through the wall. As shown in FIG. 31, the longitudinal length of the neck section 324 that is the distance between the collar section 326 and the circular cutout 332 and the longitudinal length of the shoulder section 322 that is the same as the diameter (D1) of the circular cutout 332 are configured such that the inner surface of the wall of the utility structure 400 comes to a point between ¼-¾ of D1 in the longitudinal direction. The wall has a certain thickness, for example, ⅝-½ inch such as 12 mm. D1 may be about 6.9 mm, for example.

In the configuration shown in FIGS. 29 and 31, wherein the combination of the leg holder 200 and the expansion anchor 300 is installed with the utility structure 400 with the fins 320 closed, the wedge unit 300-3 is attached at the rear end portion of the bolt 300-1 coming out from the fin unit 300-2 by engaging the inner thread of the nut section 340 of the wedge unit 300-3 with the outer thread of the shank section 306 of the bolt 300-1, wherein the protruded portions of the multiple wedge pins 344 fit in the rear end portions of the longitudinal slits 330, respectively. In the example configuration shown in FIGS. 29 and 31, part of the tapered portion 342 is inserted between the fins 320 and the threaded shank section 306 of the bolt 300-1. As an example, the tapered portion 342 may be configured to give a slope of about 40°. A typical thickness of the fins 320 may be about 1.5 mm. The diameter of the circular end edge of the tapered portion 342 may be configured to be about 23 mm. Thus, the diameter (D2) of the rear end of the fin unit 300-2 may about 23 mm+3 mm (two fins)=26 mm in the configuration wherein there is an overlap between the fins 320 and the tapered portion 342, that is, part of the tapered portion 342 is inserted between the fins 320 and the threaded shank section 306 of the bolt 300-1. D2 may be in the range of 23~25 mm in the configuration wherein there is no overlap between the fins 320 and the tapered portion 342, that is, no part of the tapered portion 342 is inserted between the fins 320 and the threaded shank section 306. The diameter of the hole in the wall may be typically about 1 inch (25.4 mm). Therefore, with these dimensions, the expansion anchor 300 with the fins 320 closed, but not overlapped with the tapered portion 342 to have D2=23~25 mm, can be smoothly inserted through the hole pre-made in the wall of the utility structure 400; and yet, the expansion anchor 300 with the fins 320 closed, but overlapped with the tapered portion 342, has the rear end diameter (D2=26 mm) that is larger than the diameter of the hole (25.4 mm). Therefore, once the fins 320 and the tapered portion 342 are overlapped inside the wall, the overlapped portion does not get back into the hole of the wall. It should be understood that the above values are cited as examples to illustrate the mechanism and the design of the present step assembly, and that these are approximate values and/or within instrumental tolerances or resolutions.

FIG. 30 is a top view of the combination of the leg holder 200 and the expansion anchor 300, which is installed with the utility structure 400 with the fins 320 opened. This is the configuration wherein the combination is secured to the utility structure 400. The opened configuration can be obtained from the closed configuration as follow. First, a wrench or other turning means is applied to the head section 302 to turn the bolt 300-1 around its axis. As explained earlier, the collar section 326 of the fin unit 300-2 is placed adjacent to and in contact with the center plate 202 of the leg holder 200, and the two side edges of the collar section 326 align and contact with the two cylinders 206-1 and 206-2, respectively. In other words, due to the collar section 326 sandwiched between the two cylinders 206-1 and 206-2, the rotational movement of the fin unit 300-2 is prohibited. Thus, when the head section 302 is turned, the fin unit 300-2 remains in the same position due to the collar section 326 being sandwiched by the two cylinders 206-1 and 206-2, and only the bolt 300-1 rotates around its axis. The inner threaded surface of the nut section 340 of the wedge unit 300-3 is engaged with the outer threaded surface of the bolt 300-1, but the rotational movement of the wedge unit 300-3 is prohibited because the wedge pins 344 are positioned in the longitudinal slits 330, respectively. As a result, the rotational energy applied by the wrench or other turning means has nowhere to go, except for being expended for moving the wedge unit 344 forward along the shank section 306 of the bolt 300-1, because the threads of the wedge unit 300-3 and the bolt 300-1 are engaged. As the wedge unit 300-3 moves forward, the tapered portion 342 provides wedging action between the fins 320 and the shank section 306 of the bolt 300-1 to gradually open the fins 320. The rigidity is the weakest at the shoulder section 322 of each fin 320 because of the presence of the circular cutouts 332. Thus, as the wedge unit 300-3 moves forward along the shank section 306 of the bolt 300-1, the bending of each fin 320 occurs at the shoulder section 322, leading to the opening of the fins 320 until the wedge pins 344 reach the longitudinal ends of the circular cutouts 332, respectively, as shown in FIG. 30. The fins 320 and other parts of the expansion anchor 300 may be made of stainless steel. Thus, once the fins 320 are open, they remain rigidly open (i.e., non-reversible), whereby the combination of the holder plate 200 and the expansion anchor 300 is secured with the utility structure 400, as shown in FIG. 30.

Figure 32:
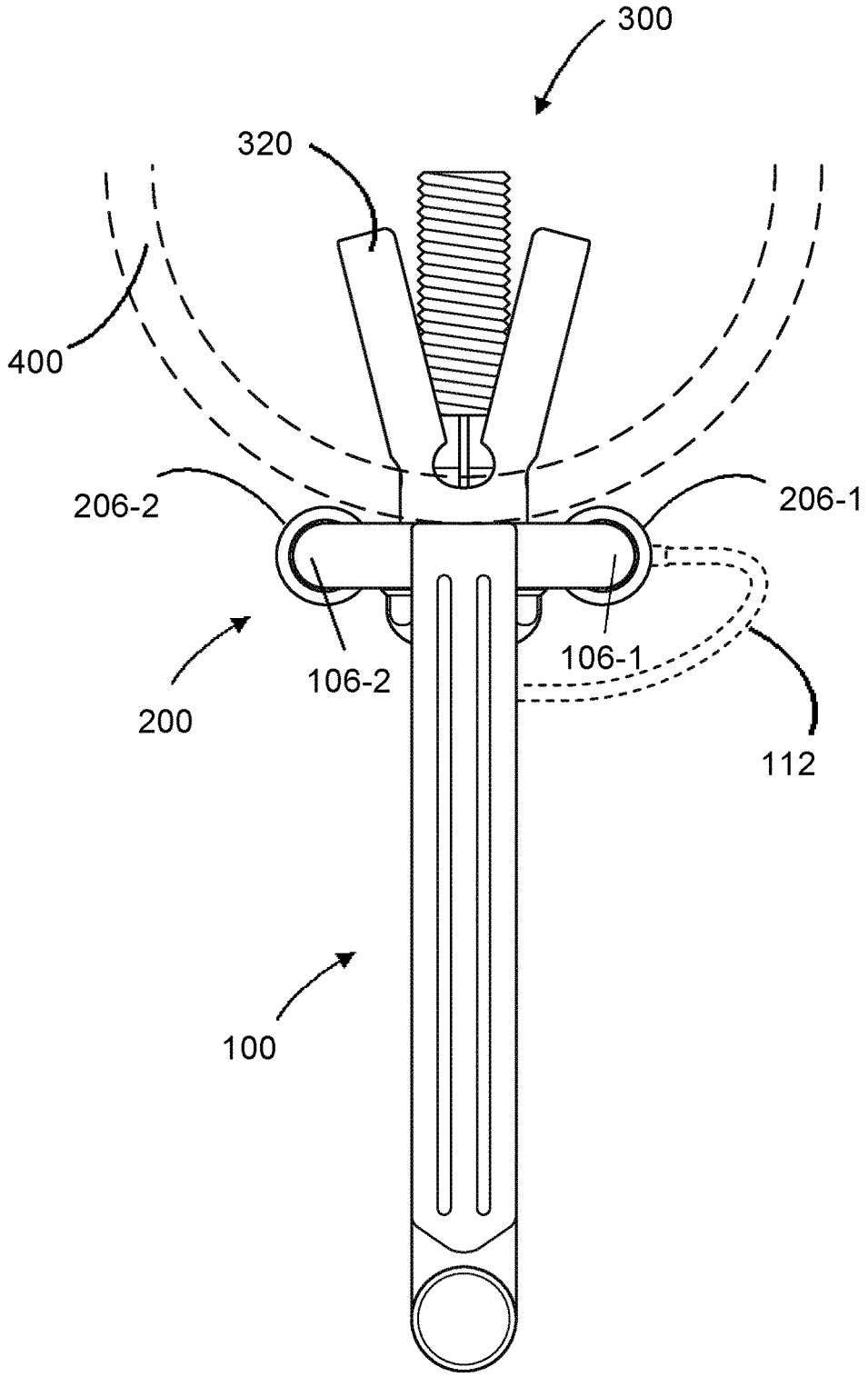
FIG. 32 is a top view of the present step assembly including the step unit attached to the combination of the leg holder and the expansion anchor, the combination being secured to the utility structure.

Once the combination of the leg holder 200 and the expansion anchor 300 is secured to the utility structure 400, owing to the opened fins 320 inside the utility structure 400 as shown in FIG. 30, the step unit 100 can be detachably attached to the installed combination. FIG. 32 is a top view of the present step assembly including the step unit 100 attached to the combination of the leg holder 200 and the expansion anchor 300, the combination being secured to the utility structure 400. The perspective view of the step assembly when installed is similar to the illustration in FIG. 1, except that the fins 320 are opened in FIG. 32 instead of being closed as in FIG. 1. The step unit 100 can be detachably attached to the combination by manually inserting the two leg members 106-1 and 106-2 through the corresponding cylinders 206-1 and 206-2 of the leg holder 200, respectively. To further secure the attachment, the pin at the end of the connection unit 112 may be inserted through the hole 114 made at an end portion of one of the leg members 106-1 and 106-2, as shown in FIGS. 1 and 28. After the use for climbing the utility structure 400, the utility worker can remove the step unit 100 leaving the combination of the leg holder 200 and the expansion anchor 300 secured to the utility structure 400. He can bring back the removed step unit 100 and attach it to the combination already secured to the utility structure 400 for the next use for climbing the utility structure 400.

Thus, according to the embodiment of the present step assembly, the combination of the leg holder 200 and the expansion anchor 300 can be made by inserting the expansion anchor 300 through the circular opening 204 of the center plate 202 of the leg holder 200 to have the plurality of fins 320 on one side of the center plate 202. As the wedge unit 300-3 moves forward, the tapered portion 342 provides wedging action between the fins 320 and the shank section 306 of the bolt 300-1 to gradually open the fins 320. The movement of the wedge unit 300-3 is enabled by the rotational energy provided at the head section 302 of the bolt 300-1. The combination is secured with the utility structure 400 based on the bending of the plurality of fins 320 at the shoulder sections 322 to have the plurality of fins 320 opened inside the utility structure 400 while the leg holder 200 is positioned in contact with and outside the utility structure 400. Thereafter, the step unit 100 can be detachably attached to the secured combination by inserting the two leg members 106-1 and 106-2 through the two cylinders 206-1 and 206-2 of the leg holder 200, respectively.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A step assembly with fall arrest capability for use for climbing a utility structure, the step assembly comprising:

a step unit comprising:

a rod having a flat surface along a longitudinal direction for placing a foot thereon for climbing, two leg members transversally coupled to the rod, and a loop section attached to the rod, on a side opposite to the flat surface, wherein two end portions of the loop section are attached at different points of the rod, thereby providing a generally D-shaped opening defined by the loop section and part of the rod between the two end portions of the loop section;

a leg holder comprising:

a center plate having a circular opening, and two cylinders formed along two side edges of the center plate, respectively, wherein the two cylinders are configured for the two leg members to be inserted therethrough, respectively; and an expansion anchor comprising:

a fin unit comprising a plurality of fins cylindrically disposed, each fin having a generally rectangle portion and a shoulder section formed contiguous to the rectangle portion, the shoulder section having a transversal dimension smaller than that of the generally rectangle portion;

wherein a combination of the leg holder and the expansion anchor is configured by inserting the expansion anchor through the circular opening of the center plate of the leg holder to have the plurality of fins on one side of the center plate, and the combination is configured to be secured with the utility structure based on bending the plurality of fins at the shoulder sections to have the plurality of fins opened inside the utility structure while the leg holder is in contact with and outside the utility structure, and wherein the step unit is detachably attached to the secured combination by inserting the two leg members through the two cylinders of the leg holder, respectively.

2. The step assembly of claim 1, wherein the expansion anchor further comprises:

a wedge unit comprising a nut section and a plurality of wedge pins, wherein the nut section has a generally cylindrical shape with a threaded inner surface, the nut section including a tapered portion, and the plurality of wedge pins are formed longitudinally on the outer surface of the nut section and equally spaced apart thereon, wherein each wedge pin is longer than the length of the nut section, providing a protruded portion; and a bolt comprising a head section, a flange section formed contiguous to the head section, and a shank section formed contiguous to the flange section and having a threaded outer surface, and wherein the fin unit of the expansion anchor further comprises:

a neck section having a generally ring shape with a first ring edge at one end and a second ring edge at the other end, the neck section being formed contiguous to the plurality of shoulder sections at the first ring edge; and a collar section having a generally square shape formed transversally to the neck section, the collar section having a collar opening, the edge of which is formed contiguous to the second ring edge of the neck section, wherein the expansion anchor is configured to be assembled by inserting the shank section of the bolt through the collar opening of the collar section of the fin unit and engaging the threaded inner surface of the nut section of the wedge unit with the threaded outer surface of the shank section of the bolt.

3. The step assembly of claim 2, wherein the combination of the leg holder and the expansion anchor is configured by placing the center plate of the leg holder adjacent to and in contact with a rear side of the collar section of the fin unit, and placing the flange section of the bolt adjacent to and in contact with a front side of the collar section, wherein side edges of the collar section align and contact with the two cylinders of the leg holder, respectively, to prevent the fin unit from moving rotationally around its axis in the combination.

4. The step assembly of claim 3, wherein the plurality of wedge pins of the wedge unit are configured to be positioned in longitudinal slits, respectively, each longitudinal slit being provided between a pair of adjacent fins of the fin unit, to prevent the wedge unit from moving rotationally around its axis in the combination.

5. The step assembly of claim 4, wherein the tapered portion of the wedge unit provides wedging action between the plurality of fins and the shank section of the bolt to gradually open the plurality of fins based on bending at the shoulder sections as the wedge unit moves forward along the shank section of the bolt via the engaged threads of the wedge unit and the bolt, wherein the movement is enabled by rotational energy provided at the head section of the bolt.

6. The step assembly of claim 1, wherein the flat surface of the rod of the step unit has grooves or ridges formed along the longitudinal direction to reduce transversal slippage of the foot.

7. The step assembly of claim 1, wherein the step unit further comprises a second rod formed contiguous and transversal to the rod, to prevent the foot from slipping sideways.

8. The step assembly of claim 1, further comprising a connection unit attached to the step unit, the connection unit including a pin at one end, wherein a hole is made through at an end portion of one of the leg members, and the pin is configured to be inserted through the hole after assembling the step assembly.

9. The step assembly of claim 1, wherein the step unit further includes a bumper formed at a rear side of the loop section to provide a substantially flat vertical surface to meet a head of a bolt.

10. The step assembly of claim 1, wherein each adjacent pair of the plurality of fins is formed to have a longitudinal slit therebetween, wherein a front end of the longitudinal slit is extended to form a circular cutout, and the shoulder section of each fin is formed between a pair of adjacent circular cutouts, giving the weakest rigidity in the fin unit.

11. The step assembly of claim 10, wherein a location and a size of each circular cutout are configured such that an inner surface of the utility structure comes to a point between ¼-¾ of a diameter of the circular cutout in the longitudinal direction, when the combination of the leg holder and the expansion anchor is installed with the utility structure.

* * * * *